US012709791B2

(12) United States Patent
Ha et al.

(10) Patent No.: US 12,709,791 B2
(45) Date of Patent: Aug. 18, 2026

(54) HIGH-STRENGTH GALVANNEALED STEEL SHEET HAVING EXCELLENT POWDERING RESISTANCE AND MANUFACTURING METHOD THEREFOR

(71) Applicant: POSCO CO., LTD, Pohang-si (KR)

(72) Inventors: Yu-Mi Ha, Gwangyang-si (KR); Jun-Sung Yeom, Gwangyang-si (KR); Ji-Ho Hong, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 447 days.

(21) Appl. No.: 18/265,412

(22) PCT Filed: Dec. 9, 2021

(86) PCT No.: PCT/KR2021/018612
§ 371 (c)(1),
(2) Date: Jun. 5, 2023

(87) PCT Pub. No.: WO2022/124812
PCT Pub. Date: Jun. 16, 2022

(65) Prior Publication Data

US 2024/0026511 A1 Jan. 25, 2024

(30) Foreign Application Priority Data

Dec. 11, 2020 (KR) ..... 10-2020-0173353

(51) Int. Cl.
*C23C 2/02* (2006.01)
*C21D 8/0221* (2026.01)
(Continued)

(52) U.S. Cl.
CPC ..... *C23C 2/024* (2022.08); *C21D 8/0226* (2013.01); *C21D 8/0236* (2013.01);
(Continued)

(58) Field of Classification Search
CPC ..... C23C 2/024; C23C 2/02; C23C 2/0224; C23C 2/06; C23C 2/26; C23C 2/28;
(Continued)

(56) References Cited

U.S. PATENT DOCUMENTS

2013/0008571 A1 1/2013 Okuda et al.
2021/0071277 A1 3/2021 Han et al.

FOREIGN PATENT DOCUMENTS

CN 111527230 A 8/2020
JP H03274251 12/1991
(Continued)

OTHER PUBLICATIONS

JP-2009132972-A Translation (Year: 2009).*
(Continued)

*Primary Examiner* — Danielle M. Carda
(74) *Attorney, Agent, or Firm* — CANTOR COLBURN LLP

(57) ABSTRACT

Provided is a galvannealed steel sheet having excellent powdering resistance, and a manufacturing method therefor. The galvannealed steel sheet includes: base iron; and an alloying hot-dip galvanized layer provided on the surface thereof. The base iron includes, by weight %; 0.003 to 0.009% of carbon (C); 0.05% or less of silicon (Si); 0.4 to 1.0% of manganese (Mn); 0.04 to 0.09% of phosphorus (P); 0.01% or less of sulfur (S); 0.005% or less of nitrogen (N); 0.1% or less of aluminum (S.Al); 0.05 to 0.08% of molybdenum (Mo); 0.005 to 0.03% of titanium (Ti); 0.02 to 0.045% of niobium (Nb); 0.06 to 0.1% of copper (Cu); 0.0015% or less of boron (B), and a balance of Fe and inevitable impurities. An average thickness of a gamma (γ) phase present at an interface between the base iron and the alloying hot-dip galvanized layer is 0.20 μm or less.

8 Claims, 1 Drawing Sheet

(51) Int. Cl.

| | |
|---|---|
| ***C21D 8/0278*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C23C 2/06*** | (2006.01) |
| ***C23C 2/26*** | (2006.01) |
| ***C23C 2/28*** | (2006.01) |

(52) U.S. Cl.
CPC ..... *C21D 8/0278* (2013.01); *C21D 9/46* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C23C 2/02* (2013.01); *C23C 2/0224* (2022.08); *C23C 2/06* (2013.01); *C23C 2/26* (2013.01); *C23C 2/28* (2013.01); *C21D 2211/005* (2013.01)

(58) Field of Classification Search
CPC .. C23C 2/022; C23C 2/29; C23C 2/40; C23C 2/52; C21D 8/0226; C21D 8/0236; C21D 8/0278; C21D 9/46; C21D 2211/005; C21D 8/0263; C21D 8/0273; C21D 8/0221; C22C 38/001; C22C 38/002; C22C 38/004; C22C 38/02; C22C 38/04; C22C 38/06; C22C 38/12; C22C 38/14; C22C 38/16; B21B 27/005; B32B 15/013
USPC ..... 148/533
See application file for complete search history.

(56) References Cited

FOREIGN PATENT DOCUMENTS

| | | | | | |
|---|---|---|---|---|---|
| JP | H08165551 | | | 6/1996 | |
| JP | 2695259 | | | 12/1997 | |
| JP | 2001279409 | | | 10/2001 | |
| JP | 2002060917 | | | 2/2002 | |
| JP | 2009132972 | A | * | 6/2009 | |
| JP | 2010077480 | A | | 4/2010 | |
| JP | 2013076132 | A | | 4/2013 | |
| JP | 2014015651 | A | | 1/2014 | |
| JP | 2015017289 | A | | 1/2015 | |
| JP | 2015101776 | | | 6/2015 | |
| KR | 20110046653 | | | 5/2011 | |
| KR | 20120113791 | | | 10/2012 | |
| KR | 101449135 | | | 10/2014 | |
| KR | 20160078827 | | | 7/2016 | |
| KR | 20160078827 | A | * | 7/2016 | ..... C23C 2/06 |
| WO | 2004003247 | A1 | | 1/2004 | |
| WO | 2007007983 | A1 | | 1/2007 | |

OTHER PUBLICATIONS

KR 2016-0078827A Translation (Year: 2016).*
Japanese Office Action—Japanese Application No. 2023-534939 issued on Sep. 3, 2024, citing JP 2010-077480, JP 2001-279409, and JP 2009-132972.
International Search Report—PCT/KR2021/018612 dated Mar. 21, 2022.
Chinese Office Action—Chinese Application No. 202180080233.5 issued on Feb. 4, 2026, citing JP 2009-132972, JP 2001-279409, CN 111527230, and JP 2015-017289.
European Search Report—European Application No. 21903858.5 issued on Apr. 30, 2024, citing JP 2013-076132, WO 2004/003247, KR 10-1449135, WO 2007/007983, and JP 2014-015651.

* cited by examiner

HIGH-STRENGTH GALVANNEALED STEEL SHEET HAVING EXCELLENT POWDERING RESISTANCE AND MANUFACTURING METHOD THEREFOR

TECHNICAL FIELD

The present disclosure relates to a galvannealed steel sheet and a manufacturing method therefor, and more particularly, to a galvannealed steel sheet having high strength properties and excellent powdering resistance, which can be preferably applied as an exterior panel of automobiles, and a manufacturing method therefor.

BACKGROUND ART

A galvannealed steel sheet (GA steel sheet) is obtained by heating a hot-dip galvanized steel sheet (GI steel sheet) to diffuse Fe in a base steel sheet into a plating layer, and alloying Fe and Zn. Since the GA steel sheet has excellent strength, weldability, and corrosion resistance after painting, and the like, the GA steel sheet is a material mainly used for, for example, automobile frame members (members serving to absorb energy during a collision, or the like).

Recently, attempts have been made to apply GA steel sheets to an exterior panel of automobiles, according to the demand for high strength of automobile bodies, but GA steel sheets are not actively used as the exterior panel of automobiles. The GA steel sheet has a problem in which a plating layer is peeled off in a powdery form during forming, so-called powdering, which is because there are technical difficulties to be solved in applying the GA steel sheet to the exterior panel of automobiles that is formed into a complex shape.

As a method for improving powdering resistance of the GA steel sheet, a method of reducing a brittle gamma (γ) phase by lowering a concentration of iron in a Fe—Zn alloy plating layer has been proposed. In addition, as in Patent Document 1, a technique of improving powdering resistance and flaking resistance, by adjusting an amount of a zeta (ζ) phase, a delta (δ) phase, and a gamma (γ) phase in the plating layer, and suppressing formation of the gamma (γ) phase at an interface between base iron and a plating layer and controlling surface roughness to a low level, has been proposed. However, even with this method, it is not possible to sufficiently secure powdering resistance, so that a GA steel sheet, suitable for an exterior panel of automobiles by having strength characteristics that meet the recent trend for high tensile strength while promoting weight reduction and being formed into a complex shape, may not be provided.

Prior Art Document (Patent Document) Japanese Patent Registration No. 2695259

SUMMARY OF INVENTION

Technical Problem

An aspect of the present disclosure is to provide a galvannealed steel sheet having high strength properties and excellent powdering resistance and a manufacturing method therefor.

The subject of the present invention is not limited to the above. The subject of the present invention will be understood from the overall content of the present specification, and those of ordinary skill in the art to which the present invention pertains will have no difficulty in understanding the additional subject of the present invention.

Solution to Problem

According to an aspect of the present disclosure, a galvannealed steel sheet, includes: base iron; and a alloying hot-dip galvanized layer provided on at least one surface of the base iron, wherein the base iron includes, by weight %; 0.003 to 0.009% of carbon (C); 0.05% or less of silicon (Si); 0.4 to 1.0% of manganese (Mn); 0.04 to 0.09% of phosphorus (P); 0.01% or less of sulfur (S); 0.005% or less of nitrogen (N); 0.1% or less of aluminum (S.Al); 0.05 to 0.08% of molybdenum (Mo); 0.005 to 0.03% of titanium (Ti); 0.02 to 0.045% of niobium (Nb); 0.06 to 0.1% of copper (Cu); 0.0015% or less of boron (B), and a balance of Fe and other inevitable impurities, the base iron satisfying the following Relational expression 1 is satisfied, wherein an average thickness of a gamma (γ) phase present at an interface between the base iron and the alloying hot-dip galvanized layer may be 0.20 μm or less, $$0.08 \le [Ti]/\{48 * ([Mo]/96 + [Si]/28)\} \le 0.3 \quad \text{[Relational expression 1]}$$

where [Ti], [Mo], and [Si] are contents (wt %) of titanium (Ti), molybdenum (Mo), and silicon (Si) contained in the base iron, respectively.

An occupied area ratio of a delta (δ) phase on a surface of the alloying hot-dip galvanized layer may be 80 to 100%.

The alloying hot-dip galvanized layer may include, by weight %, 0.05 to 0.3% of aluminum (Al); 10 to 20% of iron (Fe), and a balance of zinc (Zn) and other inevitable impurities.

The base iron may include 95 area % or more of ferrite, and an average grain size of the ferrite may be 15 μm or less.

The alloying hot-dip galvanized layer may have a tensile strength of 390 MPa or more and an elongation of 28% or more.

According to an aspect of the present disclosure, a manufacturing method for a galvannealed steel sheet may include operations of: preparing a cold-rolled steel sheet including, by weight %: 0.003 to 0.009 of carbon (C); 0.05% or less of silicon (Si); 0.4 to 1.0% of manganese (Mn); 0.04 to 0.09% of phosphorus (P); 0.01 or less of sulfur (S); 0.005% or less of nitrogen (N); 0.1% or less of aluminum (S.Al); 0.05 to 0.08 of molybdenum (Mo); 0.005 to 0.03% of titanium (Ti); 0.02 to 0.045% of niobium (Nb); 0.06 to 0.1% of copper (Cu); 0.0015% or less of boron (B), and a balance of Fe, and other inevitable impurities, the cold-rolled steel sheet satisfying the following Relational expression 1; dipping the cold-rolled steel sheet in a hot-dip galvanizing bath at an inlet temperature of 490 to 500° C., based on a surface temperature of the cold-rolled steel sheet to provide a plated steel sheet having alloying hot-dip galvanized layer formed thereon; and heating the plated steel sheet to a temperature range of 500 to 560° C. to subject the plated steel sheet to alloying, $$0.08 \le [Ti]/\{48*([Mo]/96+[Si]/28)\} \le 0.3 \quad \text{[Relational expression 1]}$$

where [Ti], [Mo], and [Si] are contents (wt %) of titanium (Ti), molybdenum (Mo), and silicon (Si) contained in the cold-rolled steel sheet, respectively.

The hot-dip galvanizing bath may include, by weight, 0.05 to 0.5% of aluminum (Al), and a balance of zinc (Zn) and other inevitable impurities.

The operation of preparing the cold-rolled steel sheet may include operations of: manufacturing a slab provided with a predetermined alloy composition by continuous casting; heating the slab at 1100 to 1300° C.; hot rolling the heated slab at a finish rolling temperature of 920 to 970° C. to obtain a hot-rolled steel sheet; coiling the hot-rolled steel sheet in a temperature range of 600 to 650° C.; pickling the hot-rolled steel sheet and then cold rolling the hot-rolled steel sheet at a reduction ratio of 70 to 83% to obtain a cold-rolled steel sheet; and annealing the cold-rolled steel sheet in a temperature range of 760 to 820° C.

The method for manufacturing the galvannealed steel sheet may further include an operation of temper rolling the galvannealed steel sheet at a rolling reduction ratio of 0.6% to 1.2% using a skin pass roll having surface roughness (Ra) of 1.0 to 1.6 μm.

The means for solving the above problems do not enumerate all the features of the present invention, and the various features of the present invention and the advantages and effects thereof will be understood in more detail with reference to the specific embodiments and examples below.

Advantageous Effects of Invention

As set forth above, according to an aspect of the present disclosure, a galvannealed steel sheet having high-strength properties and excellent powdering resistance, and thus having preferable physical properties as an exterior panel of automobiles, and a method for manufacturing the same, may be provided.

The effect of the present invention is not limited to the above, and may be interpreted as including matters that can be reasonably inferred from the matters described in this specification by those skilled in the art.

BEST MODE FOR INVENTION

Figure 1:
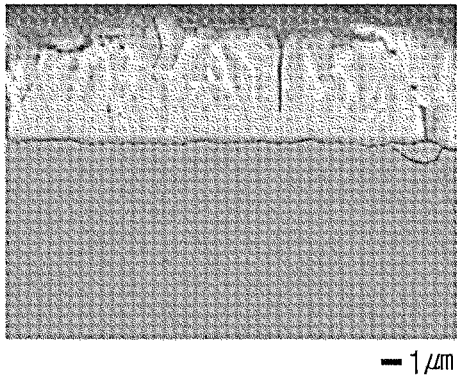
FIG. 1 is a photograph of a cross-section of specimen 1 observed using an SEM.
Figure 2:
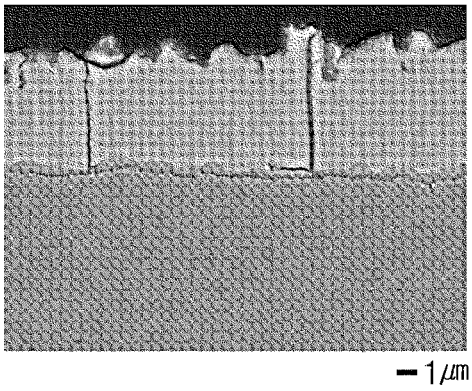
FIG. 2 is a photograph of a cross-section of specimen 14 observed using an SEM.

The present disclosure relates to a high-strength galvannealed steel sheet having excellent powdering resistance and a method for manufacturing the same. Hereinafter, preferred embodiments of the present disclosure will be described. Embodiments of the present disclosure may be modified in various forms, and the scope of the present disclosure should not be construed as being limited to the embodiments described below.

Hereinafter, a galvannealed steel sheet according to an aspect of the present disclosure will be described in more detail.

According to an aspect of the present disclosure, a galvannealed steel sheet includes: base iron; and an alloying hot-dip galvanized layer provided on at least one surface of the base iron, wherein the base iron includes, by weight %; 0.003 to 0.009% of carbon (C); 0.05% or less of silicon (Si); 0.4 to 1.0% of manganese (Mn); 0.04 to 0.09% of phosphorus (P); 0.01% or less of sulfur (S); 0.005% or less of nitrogen (N); 0.1% or less of aluminum (S.Al); 0.05 to 0.08% of molybdenum (Mo); 0.005 to 0.03% of titanium (Ti); 0.02 to 0.045% of niobium (Nb); 0.06 to 0.1% of copper (Cu); 0.0015% or less of boron (B), and a balance of Fe and other inevitable impurities, the base iron satisfying the following Relational expression 1, wherein an average thickness of a gamma (γ) phase present at an interface between the base iron and the alloying hot-dip galvanized layer may be 0.20 μm or less, $$0.08 \le [Ti]/\{48 * ([Mo]/96 + [Si]/28)\} \le 0.3 \quad \text{[Relational expression 1]}$$

In the Relational expression 1, [Ti], [Mo], and [Si] are contents (wt %) of titanium (Ti), molybdenum (Mo), and silicon (Si) contained in the base iron, respectively.

Hereinafter, a composition of steel included in the base iron of the present disclosure will be described in more detail. Hereinafter, % herein representing a content of each element is based on weight, unless otherwise specified.

Carbon (C): 0.003 to 0.009%

Carbon (C) is an element that greatly affects formation of a texture of the steel sheet during cold rolling and annealing, as an interstitial solid-solution element. When an amount of carbon dissolved in steel increases, growth of grains having {111} gamma (γ)-fiber textures, advantageous for drawing, is suppressed, and growth of grains having {110} and {100} textures is promoted, so that drawability of an annealed sheet deteriorates. Furthermore, when a content of C is excessive, a content of titanium (Ti) and niobium (Nb) required to precipitate carbon (C) as a carbide increases, which is not only disadvantageous in terms of economics, but also may deteriorate formability, since pearlite, or the like, are generated. Therefore, an upper limit of the content of C may be limited to 0.009% in the present disclosure. Preferably, an upper limit of the content of C may be 0.008%, and more preferably, an upper limit of the content of C may be 0.007%. However, since sufficient strength cannot be secured when the content of carbon (C) is excessively small, in the present disclosure, a lower limit of the content of carbon (C) content may be limited to 0.003%. Preferably, the lower limit of the content of carbon (C) may be 0.004%.

Silicon (Si): 0.05% or Less

Silicon (Si) is an element contributing to an increase in strength by solid solution strengthening. In the present disclosure, silicon (Si) may be added to exhibit an effect of increasing strength. In the present disclosure, although a lower limit of a content of silicon (Si) is not specifically defined, 0% may be excluded from a lower limit thereof. Preferably, the lower limit of the content of silicon (Si) may be 0.01%, and more preferably, the lower limit of the content of silicon (Si) may be 0.02%. However, when the content of silicon (Si) is excessive, surface scale defects may be caused to deteriorate plating surface properties, so that, in the present disclosure, an upper limit of the content of silicon (Si) may be limited to 0.05%. More preferably, the upper limit of the content of silicon (Si) may be 0.04%.

Manganese (Mn): 0.4 to 1.0%

Manganese (Mn) is a solid solution strengthening element not only contributing to increases in strength but also serving to precipitate sulfur (S) in steel as MnS. In the present disclosure, 0.4% or more of manganese (Mn) may be added to obtain such an effect. Preferably, a lower limit of a content of manganese (Mn) may be 0.45%. However, when the content of manganese (Mn) is excessive, since surface quality degradation due to oxides may occur, in the present disclosure, an upper limit of the content of manganese (Mn) may be limited to 1.0%. Preferably, the upper limit of the content of manganese (Mn) may be 0.9%, and more preferably, the upper limit of the content of manganese (Mn) may be 0.85%.

Phosphorous (P): 0.04 to 0.09%

Phosphorous (P) is the most effective element for securing strength of steel, having the most excellent solid-solution strengthening effect, and without significantly impairing drawability. In the present disclosure, 0.04% or more of phosphorus (P) may be added for this effect. Preferably, a content of phosphorus (P) may be greater than 0.04%, and more preferably, the content of phosphorus (P) may be 0.045% or more. On the other hand, when phosphorus (P) is excessively added, secondary brittleness and surface linear defects due to segregation of phosphorus (P) may occur, so that, in the present disclosure, an upper limit of the content of phosphorous (P) may be limited to 0.09%. More preferably, the upper limit of the content of phosphorus (P) may be 0.085%.

Sulfur (S): 0.01% or Less, Nitrogen (N): 0.005% or Less

Sulfur (S) and Nitrogen (N) are components that are inevitably added as impurities present in steel, and it is preferable to control a content of S to be as low as possible in order to secure welding characteristics. Therefore, in the present disclosure, the content of sulfur (S) may be limited to be 0.01% or less (including 0%), and the content of nitrogen (N) may be limited to be 0.005% or less (including 0%). In addition, considering an amount thereof that is inevitably added, in the present disclosure, 0% may be excluded from a lower limit of the contents of sulfur (S) and nitrogen (N).

Aluminum (S.Al): 0.1% or Less

Aluminum (Al) is a component contributing to improving drawability and ductility of steel by precipitating AlN, and in the present disclosure, aluminum (Al) may be added to secure such an effect. Preferably, a content of aluminum (Al) may be greater than 0%, and more preferably, the content of aluminum (Al) may be 0.01% or more. On the other hand, when aluminum (Al) is excessively added, aluminum (Al) inclusions may be excessively formed during a steelmaking operation, which may cause internal defects in the steel sheet, so that in the present disclosure, an upper limit of the content of aluminum (Al) may be limited to 0.1%.

Molybdenum (Mo): 0.05 to 0.08%

The inventor of the present invention has conducted in-depth research on a method for preventing surface quality deterioration due to grain boundary segregation of phosphorus (P), while promoting high strength through an addition of phosphorous (P), and as a result thereof, it was found that when an appropriate amount of molybdenum (Mo) is added to steel, molybdenum (Mo), having a high affinity for phosphorus (P), forms a MoP compound, and accordingly, grain boundary segregation of phosphorus (P) may be effectively prevented. Therefore, in the present disclosure, 0.05% or more of molybdenum (Mo) may be included to achieve such an effect. More preferably, a lower limit of a content of molybdenum (Mo) may be 0.055%. However, when molybdenum (Mo) is excessively added, a formation effect of the MoP compound is saturated, but cost competitiveness is greatly reduced, so in the present disclosure, an upper limit of the content of molybdenum (Mo) may be limited to 0.08%. Preferably, the upper limit of the content of molybdenum (Mo) may be limited to 0.075%.

Titanium (Ti): 0.005 to 0.03%

Titanium (Ti) is an element greatly contributing to improving drawability of a steel sheet by reacting with solid-solution carbon and solid-solution nitrogen to precipitate titanium (Ti) as a titanium (Ti)-based carbonitride during hot rolling. In the present disclosure, 0.005% or more of titanium (Ti) may be added to secure such an effect. Preferably, a lower limit of a content of titanium (Ti) may be 0.007%. On the other hand, when the content of titanium (Ti) is excessive, it is difficult to manage inclusions during a steelmaking operation and inclusion property defects may occur. Therefore, in the present disclosure, an upper limit of the content of titanium (Ti) may be limited to 0.03%. Preferably, the upper limit of the content of titanium (Ti) may be 0.025%.

Niobium (Nb): 0.02 to 0.04%

Niobium (Nb) is the most effective element, contributing to solute drag and precipitate pinning during hot rolling, and capable of forming very fine grains through rolling and cooling processes when a non-crystallized region of an austenite region is widened at a high temperature. In the present disclosure, 0.02% or more of niobium (Nb) may be added to promote such crystal grain refinement. Preferably, a lower limit of a content of niobium (Ni) may be 0.025%. On the other hand, when niobium (Nb) is excessively added, high-temperature strength may increase and a hot-rolling load may become excessive, so that in the present disclosure, an upper limit of the content of niobium (Nb) may be limited to 0.004%. Preferably, the upper limit of the content of niobium (Nb) may be 0.035%.

Copper (Cu): 0.06 to 0.1%

Copper (Cu) is a component contributing to improving strength of steel. In the present disclosure, 0.06% or more of copper (Cu) may be added for this effect. Preferably, a lower limit of a content of copper (Cu) may be 0.065%, and more preferably, the lower limit of the content of copper (Cu) may be 0.07%. On the other hand, when an amount of copper (Cu) added is excessive, leading to grain boundary embrittlement or costs, so in the present disclosure, an upper limit of the content of copper (Cu) may be limited to 0.1%. More preferably, the upper limit of the content of copper (Cu) may be 0.09%.

Boron (B): 0.0015% or Less

Boron (B) is a component to prevent secondary processing brittleness due to addition of phosphorus (P) in steel, and in the present disclosure, boron (B) may be added to prevent secondary processing brittleness. Preferably, a lower limit of a content of boron (B) may be 0.0002%, and more preferably, the lower limit of the content of boron (B) may be 0.0004%. However, when the content of boron (B) is excessive, since the ductility of the steel sheet may be reduced, in the present disclosure, an upper limit of the content of boron (B) may be limited to 0.0015%. Preferably, the upper limit of the content of boron (B) may be 0.001%.

The base iron of the present disclosure may include a balance of Fe and other inevitable impurities in addition to the above-mentioned components. However, in a general manufacturing process, inevitable impurities may be inevitably added from raw materials or an ambient environment, and thus, impurities may not be excluded. A person skilled in the art of a general manufacturing process may be aware of the impurities, and thus, the descriptions of the impurities may not be provided in the present disclosure. In addition, additional addition of effective components other than the above-mentioned components is not entirely excluded.

Base iron of the present disclosure may satisfy the following Relational expression 1.

$$0.08 \leq [Ti]/\{48 * ([Mo]/96 + [Si]/28)\} \leq 0.3 \quad \text{[Relational expression 1]}$$

In the relational expression 1, [Ti], [Mo], and [Si] are contents (wt %) of titanium (Ti), molybdenum (Mo), and silicon (Si) contained in the base iron, respectively.

The inventor of the present invention has conducted in-depth research on a method of improving powdering resistance of an alloying plating layer, while promoting high strength through an addition of phosphorous (P) to base iron, and as a result thereof, it was confirmed that, when relative contents of titanium (Ti), molybdenum (Mo), and silicon (Si) contained in the base iron are controlled to be within a specific range, an alloying degree of the plating layer may be controlled, and formation of a gamma (γ) phase at an interface between the base iron and the alloyed plating layer may be effectively suppressed. That is, in the present disclosure, since the relative contents of titanium (Ti), molybdenum (Mo), and silicon (Si) included in the base iron are controlled to be within a certain range using Relational expression 1, an average thickness of the gamma (γ) phase formed at the interface between the alloyed plating layer and the base iron may be limited to 0.20 μm or less, and thus the powdering resistance of the plating layer may be effectively secured.

The base iron of the present disclosure may include ferrite as a base structure, and may further include other microstructures such as pearlite, or the like, which are inevitably formed, as a remaining structure. Since the base iron of the present disclosure includes ferrite as a base structure, it is possible to effectively secure the formability of the plated steel sheet. In the present disclosure, a fraction of ferrite may be 95 area % or more, and a more preferable fraction of ferrite may be 99 area % or more. An average grain size of the ferrite may be 15 μm or less.

A galvannealed steel sheet according to an aspect of the present disclosure, a galvannealed steel sheet may include an alloying hot-dip galvanized layer provided on at least one surface of base iron, wherein the alloying hot-dip galvanized layer may include, by weight %, 0.05 to 0.3% of aluminum (Al), 10 to 20% of iron (Fe): 10-20%, a balance of zinc (Zn) and other inevitable impurities.

In the galvannealed steel sheet according to an aspect of the present disclosure, a gamma (γ) phase having a constant thickness may be formed at an interface between the base iron and the alloying hot-dip galvanized layer, and a preferred average thickness of the gamma (γ) phase is 0.20 μm or less. In the present disclosure, although a lower limit of the thickness of the gamma (γ) phase is not specifically defined, 0 μm may be excluded from the lower limit of the thickness of the gamma (γ) phase in consideration of the inevitably formed amount. Preferably, the gamma (γ) phase may have a thickness of 0.02 μm or more. According to an aspect of the present disclosure, in a galvannealed steel sheet, since the average thickness of the gamma (γ) phase formed at the interface between the base iron and the alloying hot-dip galvanized layer is controlled to be within a range of 0.20 μm or less, the powdering resistance of the plating layer is may be effectively secured.

An occupied area ratio of a delta (δ) phase observed on a surface of the galvannealed steel sheet of the present disclosure may be 80 to 100%. In the present disclosure, since the occupied area ratio of the delta (δ) phase observed on a surface of the plating layer is limited to 80% or more, a coefficient of friction may be reduced, and accordingly, excellent flaking resistance may be secured.

The galvannealed steel sheet according to an aspect of the present disclosure may have a tensile strength of 390 MPa or more and an elongation of 28% or more. In addition, since the galvannealed steel sheet according to an aspect of the present disclosure may not only have high-strength properties and excellent processability, but also excellent powdering resistance, the galvannealed steel sheet may have physical properties, suitable for an exterior panel of automobiles.

Hereinafter, a method for manufacturing a galvannealed steel sheet according to an aspect of the present disclosure will be described in more detail.

According to an aspect of the present disclosure, the method for manufacturing a galvannealed steel sheet may include operations of: preparing a cold-rolled steel sheet having a predetermined alloy composition; dipping the cold-rolled steel sheet in a hot-dip galvanizing bath at an inlet temperature of 490 to 500° C., based on a surface temperature of the cold-rolled steel sheet to provide a plated steel sheet having a hot-dip galvanized layer formed thereon; and subjecting the plated steel sheet to alloying in a temperature range of 500 to 560° C.

The operation of preparing the cold-rolled steel sheet may include operations of: manufacturing a slab provided with a predetermined alloy composition by continuous casting; heating the slab at 1100 to 1300° C.; hot rolling the heated slab at a finish rolling temperature of 920 to 970° C. to obtain a hot-rolled steel sheet; coiling the hot-rolled steel sheet in a temperature range of 600 to 650° C.; pickling the hot-rolled steel sheet and then cold rolling the hot-rolled steel sheet at a reduction ratio of 70 to 83% to obtain a cold-rolled steel sheet; and annealing the cold-rolled steel sheet in a temperature range of 760 to 820° C.

Manufacturing and Heating Slab

A steel slab having a predetermined component is manufactured by continuous casting. Since the steel slab of the present disclosure has an alloy composition corresponding to the alloy composition of the base iron described above, the description of the alloy composition of the steel base iron described above.

The prepared slab may be heated in a temperature range of 1100 to 1300° C. When a slab heating temperature is excessively low, an excessive rolling load may be caused during hot rolling, so a lower limit of the slab heating temperature may be limited to 1100° C. When the slab heating temperature is excessively high, a problem of surface scale defects may occur, so an upper limit of the slab heating temperature may be limited to 1300° C.

Hot Rolling

A hot-rolled steel sheet may be provided by hot rolling the heated slab. Hot rolling may be performed in a range in which a finish rolling temperature is Ar3 or higher. More specifically, the finish rolling temperature may be in a range of 900 to 970° C. When a hot-rolling temperature is excessively low, since a size of crystal grains of a final structure is excessively refined, so that a desired level of formability may not be secured, a lower limit of the finish rolling temperature may be limited to 900° C. On the other hand, when the hot-rolling temperature is excessively high, since the size of crystal grains of the final structure becomes excessively coarse, making it impossible to secure the desired strength and may cause deterioration of surface quality of a final product, in the present disclosure, an upper limit of the finish rolling temperature may be limited to 970° C.

Coiling

The hot-rolled steel sheet obtained by hot rolling may be coiled in a temperature range of 600 to 650° C. when a coiling temperature is excessively low, precipitates such as Ti(Nb)C are not sufficiently formed, resulting in a large amount of solid solution carbon, which affects behavior such as recrystallization, grain growth, and the like during annealing, which may cause a problem of securing desired strength and elongation. Therefore, in the present disclosure, a lower limit of the coiling temperature may be limited to 600° C. On the other hand, when the coiling temperature is excessively high, the surface quality may be inferior due to secondary scale generation, and an upper limit of the coiling temperature may be limited to 650° C.

Pickling and Cold Rolling

After uncoiling the coiled hot-rolled steel sheet, pickling may be performed to remove surface scales, and after pickling, cold rolling may be performed at a reduction ratio of 70 to 83% to obtain a cold-rolled steel sheet. When the reduction ratio of cold rolling is less than a certain level, a (111) texture may not be sufficiently grown, resulting in poor formability, so that in the present disclosure, a lower limit of the reduction ratio of cold rolling may be limited to 70%. A more preferable lower limit of the reduction ratio may be 74%. On the other hand, when the reduction ratio during cold rolling is excessive, shape defects may occur due to an excessive rolling roll load, and in the present disclosure, an upper limit of the reduction ratio of cold rolling may be limited to 83%. A more preferable upper limit of the reduction ratio may be 80%.

Annealing

A cold-rolled steel sheet obtained by cold rolling may be heated to a temperature equal to or higher than a recrystallization temperature and subjected to an annealing treatment. When an annealing temperature is below a certain level, strain generated by rolling may not be sufficiently removed, and ferrite recrystallization may not be completed, so the elongation may be inferior. Therefore, in the present disclosure, a lower limit of the annealing temperature may be limited to 760° C. On the other hand, when the annealing temperature is excessively high, it may progress to grain growth after completion of recrystallization, resulting in poor strength or poor surface quality. In the present disclosure, an upper limit of the annealing temperature may be limited to 820° C.

Plating and Selective Alloying

A hot-dip galvanized layer may be formed by dipping the annealed cold-rolled steel sheet in a hot-dip galvanizing bath. The hot-dip galvanizing bath used in the present disclosure, may include, by weight %, 0.05 to 0.5% of aluminum (Al), a balance of zinc (Zn) and other inevitable impurities. Since an inlet temperature during dipping in the plating bath greatly affects a degree of formation of the gamma (γ) phase, in the present disclosure, the inlet temperature during dipping in the plating bath may be limited to a range of 490 to 500° C., based on a surface temperature of the cold-rolled steel sheet.

An alloying treatment may be performed by heating the plated steel sheet having the hot-dip galvanized layer formed thereon in a temperature range of 500 to 560° C. When an alloying temperature is excessively high, there may be a concern that the gamma (γ) phase may be excessively formed, so that in the present disclosure, an upper limit of the alloying temperature may be limited to 560° C. On the other hand, when the alloying temperature is low, sufficient alloying is not achieved, and in the present disclosure, a lower limit of the alloying temperature may be limited to 500° C.

Temper Rolling

In order to securer surface quality of the plated steel sheet, temper rolling may be selectively performed. Preferably, a galvannealed steel sheet may be temper-rolled at a reduction ratio of 0.6 to 1.2% using a skin pass roll having surface roughness (Ra) of 1.0 to 1.6 μm.

The plated steel sheet manufactured by the above-described manufacturing method may have a tensile strength of 390 MPa or more and an elongation of 28% or more, as well as excellent powdering resistance.

BEST MODE FOR INVENTION

Hereinafter, a plated steel sheet of the present disclosure and a manufacturing method thereof will be described in more detail through specific examples. It should be noted that the following examples are only for understanding of the present invention, and are not intended to specify the scope of the present invention. The scope of the present invention may be determined by the matters described in the claims and the matters reasonably inferred therefrom.

EXAMPLE

A steel slab having a thickness of 250 mm having an alloy composition shown in Table 1 below was manufactured by continuous casting. After heating the steel slab to 1250° C., hot rolling was performed, and a hot-rolled coil was prepared by coiling the hot-rolled steel sheet. In this case, the conditions described in Table 2 were applied to a finish rolling temperature and coiling temperature of hot rolling. The hot-rolled coil was uncoiled and pickled, and cold-rolled at a reduction ratio of 70 to 83% to manufacture a cold-rolled steel sheet having a thickness of 0.6 to 1.0 mm. Annealing was performed under the conditions shown in Table 2 for each cold-rolled steel sheet. Thereafter, the cold-rolled steel sheet was dipped in a hot-dip galvanizing bath containing 0.12% by weight of Al to form a plating layer, followed by alloying treatment. The conditions shown in Table 2 were applied to an inlet temperature and alloying temperature when dipped in the plating bath.

TABLE 1

| Steel | Alloy composition (by weight %) | | | | | | | | | | | | [Relational |
|---|---|---|---|---|---|---|---|---|---|---|---|---|---|
| type | C | Si | P | Mo | Mn | Cu | S•Al | N | S | Ti | Nb | B | expression 1] |
| A | 0.004 | 0.028 | 0.048 | 0.058 | 0.45 | 0.08 | 0.0365 | 0.0018 | 0.0023 | 0.01 | 0.032 | 0.0008 | 0.13 |
| B | 0.007 | 0.034 | 0.078 | 0.065 | 0.72 | 0.09 | 0.0315 | 0.0015 | 0.003 | 0.021 | 0.041 | 0.0007 | 0.23 |
| C | 0.01 | 0.05 | 0.09 | 0.07 | 0.07 | 0.1 | 0.0421 | 0.0019 | 0.0032 | 0.07 | 0.01 | 0.002 | 0.58 |
| D | 0.008 | 0.03 | 0.15 | 0.06 | 0.8 | 0.13 | 0.0346 | 0.0013 | 0.0054 | 0.03 | 0.034 | 0.002 | 0.37 |
| E | 0.004 | 0.1 | 0.08 | 0.01 | 0.78 | 0.02 | 0.0397 | 0.0015 | 0.0022 | 0.01 | 0.021 | 0.001 | 0.06 |
| F | 0.0056 | 0.03 | 0.034 | 0.056 | 0.51 | 0.056 | 0.0345 | 0.0017 | 0.0034 | 0.025 | 0.021 | 0.0009 | 0.31 |
| G | 0.0066 | 0.047 | 0.058 | 0.068 | 0.78 | 0.08 | 0.0331 | 0.002 | 0.0028 | 0.008 | 0.038 | 0.0008 | 0.07 |

TABLE 2

| Specimen No. | Steel type | FDT (° C.) | CT (° C.) | Annealing temperature (° C.) | Inlet temperature of steel sheet (° C.) | GA alloying temperature (° C.) |
|---|---|---|---|---|---|---|
| 1 | A | 915 | 622 | 775 | 490 | 535 |
| 2 | A | 932 | 620 | 766 | 495 | 530 |
| 3 | A | 940 | 618 | 780 | 500 | 540 |
| 4 | A | 939 | 615 | 793 | 480 | 580 |
| 5 | A | 925 | 623 | 800 | 510 | 560 |
| 6 | A | 920 | 620 | 778 | 490 | 600 |
| 7 | A | 933 | 622 | 790 | 480 | 589 |
| 8 | A | 936 | 625 | 780 | 490 | 485 |
| 9 | B | 942 | 620 | 770 | 490 | 535 |
| 10 | B | 923 | 618 | 766 | 500 | 530 |
| 11 | B | 922 | 615 | 780 | 490 | 540 |
| 12 | B | 940 | 680 | 820 | 480 | 590 |
| 13 | B | 934 | 678 | 785 | 480 | 580 |
| 14 | C | 933 | 600 | 790 | 490 | 550 |
| 15 | D | 940 | 610 | 810 | 490 | 530 |
| 16 | E | 934 | 615 | 800 | 490 | 555 |
| 17 | F | 935 | 620 | 800 | 490 | 550 |
| 18 | G | 933 | 623 | 760 | 490 | 550 |

A tensile test was performed on each specimen to measure a tensile strength, yield strength, and break elongation. The tensile test was performed using test specimens collected in accordance with JIS No. 5 standards. An interfacial region of each specimen was observed with a SEM, and an average value was calculated by measuring a thickness of a gamma (γ) phase at three or more points. Since specimen 8 had a low alloying temperature so it was unalloyed, a gamma (γ) phase and a delta (δ) phase thereof could not be distinguished.

As for evaluating powdering resistance, after bending each specimen by 60° and then bending the specimen again by 60° in an opposite direction for the same point, a transparent tape was attached to a surface of each specimen and then detached to measure a powdering peeling width. When the powdering peeling width is 6 mm or less, it can be understood that it has suitable powdering resistance as an exterior panel for automobiles.

As illustrated in Tables 1 to 3, it can be seen that specimens satisfying an alloy composition and process conditions of the present disclosure not only have a tensile strength of 390 MPa or more and an elongation of 8% or more, but specimens not satisfying at least one of alloy composition or process conditions of the present disclosure do not satisfy a tensile strength of 390 MPa or more or an elongation of 28% or more, or poor powdering resistance is implemented. Therefore, according to an aspect of the present disclosure, it is possible to provide a galvannealed steel sheet having preferable physical properties as an exterior panel of automobiles and a manufacturing method therefor.

Although the present disclosure has been described in detail through examples above, other types of examples are also possible. Therefore, the technical spirit and scope of the claims set forth below are not limited by the embodiments.

The invention claimed is:

1. A galvannealed steel sheet, comprising:

base iron; and an alloying hot-dip galvanized layer provided on at least one surface of the base iron, wherein the base iron includes, by weight %;

0.003 to 0.009% of carbon (C); 0.05% or less of silicon (Si); 0.4 to 1.0% of manganese (Mn); 0.04 to 0.09% of phosphorus (P); 0.01% or less of sulfur(S); 0.005% or less of nitrogen (N); 0.1% or less of aluminum (S.Al); 0.05 to 0.08% of molybdenum (Mo); 0.005 to 0.03% of titanium (Ti); 0.02 to 0.045% of niobium (Nb); 0.06 to 0.1% of copper (Cu); 0.0015% or less of boron (B), and a balance of Fe and other inevitable impurities, the base iron satisfying the following Relational expression 1, wherein an average thickness of a gamma (γ) phase present at an interface between the base iron and the alloying hot-dip galvanized layer is 0.20 μm or less, and

TABLE 3

| Specimen No. | Steel type | YP (MPa) | TS (MPa) | E1. (%) | Thickness of gamma phase (μm) | Occupied area ratio of delta phase (%) | Peeling width of powdering (mm) |
|---|---|---|---|---|---|---|---|
| 1 | A | 275 | 410 | 35 | 0.08 | 99 | 3.2 |
| 2 | A | 250 | 415 | 35 | 0.09 | 99 | 4 |
| 3 | A | 235 | 412 | 32 | 0.11 | 96 | 4.6 |
| 4 | A | 255 | 421 | 34 | 0.28 | 98 | 6.2 |
| 5 | A | 265 | 399 | 35 | 0.21 | 96 | 6.8 |
| 6 | A | 311 | 405 | 36 | 0.48 | 96 | 6.5 |
| 7 | A | 270 | 411 | 35 | 0.3 | 97 | 6.1 |
| 8 | A | 277 | 415 | 35 | — | — | — |
| 9 | B | 311 | 470 | 34 | 0.08 | 98 | 2.9 |
| 10 | B | 297 | 457 | 36 | 0.12 | 97 | 4.1 |
| 11 | B | 289 | 461 | 36 | 0.1 | 98 | 5 |
| 12 | B | 270 | 438 | 36 | 1 | 90 | 6.6 |
| 13 | B | 309 | 449 | 30 | 0.8 | 92 | 6.3 |
| 14 | C | 335 | 490 | 28 | 0.31 | 98 | 6.5 |
| 15 | D | 356 | 550 | 25 | 0.21 | 98 | 6.1 |
| 16 | E | 295 | 436 | 30 | 0.25 | 98 | 6.3 |
| 17 | F | 218 | 368 | 36 | 0.31 | 97 | 6.6 |
| 18 | G | 235 | 399 | 35 | 0.25 | 98 | 6.1 |

wherein the alloying hot-dip galvanized layer, by weight %, comprises 0.05 to 0.3% of aluminum (Al); 10 to 20% of iron (Fe), and a balance of zinc (Zn) and other inevitable impurities, $$0.08 \leq [Ti]/\{48 * ([Mo]/96 + [Si]/28)\} \leq 0.3 \quad \text{[Relational expression 1]}$$

in the Relational expression, [Ti], [Mo], and [Si] are contents (wt %) of titanium (Ti), molybdenum (Mo), and silicon (Si) contained in the base iron, respectively.

2. The galvannealed steel sheet of claim 1, wherein an occupied area ratio of a delta (δ) phase on a surface of the alloying hot-dip galvanized layer is 80 to 100%.

3. The galvannealed steel sheet of claim 1, wherein the base iron comprises 95 area % or more of ferrite, and an average grain size of the ferrite is 15 μm or less.

4. The galvannealed steel sheet of claim 1, wherein the galvannealed steel sheet has a tensile strength of 390 MPa or more and an elongation of 28% or more.

5. A manufacturing method for a galvannealed steel sheet, comprising operations of:

preparing a cold-rolled steel sheet including, by weight %:

0.003 to 0.009% of carbon (C); 0.05% or less of silicon (Si); 0.4 to 1.0% of manganese (Mn); 0.04 to 0.09% of phosphorus (P); 0.01% or less of sulfur(S); 0.005% or less of nitrogen (N); 0.1% or less of aluminum (S.Al); 0.05 to 0.08% of molybdenum (Mo); 0.005 to 0.03% of titanium (Ti); 0.02 to 0.045% of niobium (Nb); 0.06 to 0.1% of copper (Cu); 0.0015% or less of boron (B), and a balance of Fe, and other inevitable impurities, the cold-rolled steel sheet satisfying the following Relational expression 1;

dipping the cold-rolled steel sheet in a hot-dip galvanizing bath at an inlet temperature of 490 to 500° C., based on a surface temperature of the cold-rolled steel sheet to provide a plated steel sheet having a hot-dip galvanized layer formed thereon; and heating the plated steel sheet to a temperature range of 500 to 560° C. to subject the plated steel sheet to alloying, $$0.08 \leq [Ti]/\{48 * ([Mo]/96 + [Si]/28)\} \leq 0.3 \quad \text{[Relational expression 1]}$$

in the Relational expression 1, [Ti], [Mo], and [Si] are contents (wt %) of titanium (Ti), molybdenum (Mo), and silicon (Si) contained in the cold-rolled steel sheet, respectively.

6. The manufacturing method for a galvannealed steel sheet of claim 5, wherein the hot-dip galvanizing bath comprises, by weight %, 0.05 to 0.5% of aluminum (Al), a balance of zinc (Zn) and other inevitable impurities.

7. The manufacturing method for a galvannealed steel sheet of claim 6, wherein the operation of preparing the cold-rolled steel sheet comprises operations of:

manufacturing a slab provided with a predetermined alloy composition by continuous casting;

heating the slab at 1100 to 1300° C.;

hot rolling the heated slab at a finish rolling temperature of 920 to 970° C. to obtain a hot-rolled steel sheet;

coiling the hot-rolled steel sheet in a temperature range of 600 to 650° C.;

pickling the hot-rolled steel sheet and then cold rolling the hot-rolled steel sheet at a reduction ratio of 70 to 83% to obtain a cold-rolled steel sheet; and annealing the cold-rolled steel sheet in a temperature range of 760 to 820° C.

8. The manufacturing method for a galvannealed steel sheet of claim 5, further comprising:

an operation of temper rolling the galvannealed steel sheet at a reduction ratio of 0.6 to 1.2% using a skin pass roll having surface roughness (Ra) of 1.0 to 1.6 μm.

* * * * *